US006519799B1

(12) United States Patent
Bartholomew

(10) Patent No.: US 6,519,799 B1
(45) Date of Patent: Feb. 18, 2003

(54) CORKSCREW TOOL AND PIPE COMBINATION

(76) Inventor: Charles Bartholomew, 271 Oak Ave., Spruce Pine, NC (US) 28777

( * ) Notice: Subject to any disclaimer, the term of this patent is extended or adjusted under 35 U.S.C. 154(b) by 0 days.

(21) Appl. No.: 09/907,259

(22) Filed: Jul. 17, 2001

(51) Int. Cl.[7] ..... B67B 7/00
(52) U.S. Cl. ..... 7/155; 7/170; 131/178
(58) Field of Search ..... 7/151, 155, 170; 131/329, 330, 178, 192

(56) References Cited

U.S. PATENT DOCUMENTS

| | | | | | |
|---|---|---|---|---|---|
| 171,752 | A | * | 1/1876 | Witte | 7/155 |
| 4,580,303 | A | * | 4/1986 | Henshaw | 7/155 |
| 5,778,896 | A | * | 7/1998 | Seals et al. | 131/178 |
| D421,557 | S | * | 3/2000 | Wang et al. | D8/42 |

* cited by examiner

*Primary Examiner*—James G. Smith
(74) *Attorney, Agent, or Firm*—Adams, Schwartz & EvansP.A. ,

(57) ABSTRACT

A corkscrew tool and pipe combination including a first handle member having a bore that extends along a longitudinal axis and communicates with one end thereof and defines a mouthpiece. An access port is located on an outer surface of the first handle member and communicates with the bore. A second handle member has a bowl in one end for holding smoking material, a helical, cork-penetrating blade that extends outwardly from an opposing end, a hole that extends transversely through the second handle member, intermediate the blade and the bowl, of a size and shape to receive the first handle member therethrough, and a channel through the second handle member that connects the bowl with the hole. The first handle member and the second handle member are configurable in a storage configuration wherein the helical, cork-penetrating blade is received in the bore of the first handle member and a use configuration wherein the first handle member is positioned transversely through the hole in the second handle member with the access port of the first handle member in communication with the channel of the second handle member to form a flow path between the mouthpiece in the first handle member and the bowl in the second handle member permitting the combination to be used as a smoking pipe and a corkscrew tool in the same use configuration.

12 Claims, 3 Drawing Sheets

CORKSCREW TOOL AND PIPE COMBINATION

TECHNICAL FIELD AND BACKGROUND OF THE INVENTION

This invention relates to a corkscrew tool and pipe combination. Smoking a pipe and drinking wine are activities commonly associated with one another. When smoking a pipe, the need or desire to open a corked bottle of wine may arise. To accomplish the task of opening corked bottle, a corkscrew is usually employed. This invention eliminates the time required to locate a corkscrew by providing it as an existing feature of the pipe. This invention is useful while entertaining in a social capacity, or while enjoying a leisurely smoke and bottle of wine individually. The corkscrew tool and pipe combination is easily assembled and disassembled by the user.

SUMMARY OF THE INVENTION

Therefore, it is an object of the invention to provide a combination corkscrew tool and pipe.

It is another object of the invention to provide a combination corkscrew tool and pipe which is easy to assemble and use.

It is another object of the invention to provide a combination corkscrew tool and pipe that may be used as a pipe for smoking.

It is another object of the invention to provide a combination corkscrew tool and pipe that may be used as a corkscrew.

It is another object of the invention to provide a combination corkscrew tool and pipe that is readily usable as both a smoking pipe and a corkscrew tool.

It is another object of the invention to provide a combination corkscrew tool and pipe that may be easily assembled in one configuration for use as both a smoking pipe and a corkscrew tool.

It is another object of the invention to provide a combination corkscrew tool and pipe that is easily disassembled from the usable pipe and corkscrew position.

These and other objects of the present invention are achieved in the preferred embodiments disclosed by providing a combination corkscrew tool and pipe including a first handle member that has a bore extending along a longitudinal axis and communicates with one end thereof that defines a mouthpiece. An access port is located on an outer surface of the first handle member and communicates with the bore. A second handle member has a bowl in one end for holding smoking material and a helical, cork-penetrating blade that extends outwardly from an opposing end. A hole extends transversely through the second handle member intermediate the blade and the bowl of a size and shape to receive the first handle member therethrough, and a channel through the second handle member that connects the bowl with the hole.

The first handle member and second handle member are configurable in a storage configuration wherein the helical, cork-penetrating blade is received in the bore of the first handle member, and a use configuration wherein the first handle member is positioned transversely through the hole in the second handle member with the access port of the first handle member in communication with the channel of the second handle member to form a flow path between the mouthpiece in the first handle member and the bowl in the second handle member to permit the combination to be used as a smoking pipe and a corkscrew tool in the same use configuration.

According to one preferred embodiment of the invention, the first handle member and the bowl of the second handle member are comprised of wood.

According to another preferred embodiment of the invention, the first handle member defines a gradually tapering outer diameter with one end having a greater diameter than the hole that extends transversely through the second handle member and with the other end of lesser diameter than the hole, such that the diameter of the first handle member and the diameter of the hole in the second handle member are equal at a point where the access port in the first handle member and the channel through the bowl of the second handle member are aligned to define a flow path.

According to yet another preferred embodiment of the invention, the bowl is fitted with a cap.

According to yet another preferred embodiment of the invention, the first handle member is circular in cross-section.

According to yet another preferred embodiment of the invention, the blade end of the second handle member includes a tapered shoulder of reduced dimension for being received within the bore of the first handle member such that the tapered shoulder and walls of the bore define an interference fit that permits the blade end to be secured within of the bore of the first handle member.

An embodiment of the method according to the invention comprises the steps of providing a first handle member having a bore that extends along a longitudinal axis and communicates with one end thereof to define a mouthpiece. An access port is located on an outer surface of the first handle member and communicates with the bore. A second handle member is provided that has a bowl in one end for holding smoking material. A helical, cork-penetrating blade extends outwardly from an opposing end. A hole extends transversely through the second handle member intermediate the blade and the bowl of a size and shape to receive the first handle member therethrough, and a channel through the second handle member to connect the bowl with the hole. The first handle member and the second handle member are configurable into a storage configuration wherein the helical, cork-penetrating blade is received in the bore of the first handle member for storage. The first handle member and the second handle member are also configurable into a use configuration wherein the first handle member is positioned transversely through the hole in the second handle member to place the access port of the first handle member in communication with the channel of the second handle member to form a flow path from the mouthpiece in the first handle member to the bowl in the second handle member permitting the combination to be used as a smoking pipe and a corkscrew tool in the same use configuration.

One preferred embodiment of the invention includes the step of producing the first handle member and the bowl of the second handle member of wood.

Another preferred embodiment of the invention includes the step of providing the first handle member with a gradually tapering outer diameter having one end of greater diameter than the hole extending transversely through the second handle member and one end of lesser diameter than the hole such that the diameter of the first handle member and the diameter of the hole in the second handle member are equal at a point where the access port in the first handle member and the channel through the bowl of the second handle member are aligned to define a flow path.

Yet another preferred embodiment of the invention includes the step of providing a cap fitted to the bowl of the second handle member.

Yet another preferred embodiment of the invention includes the step of providing the first handle member with a circular cross-section.

Yet another preferred embodiment of the invention includes the step of providing the blade end of the second handle member with a tapered shoulder of reduced dimension for being received within the bore of the first handle member such that the tapered shoulder and walls of the bore define an interference fit permitting the blade end to be secured within the walls of the bore of the first handle member.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
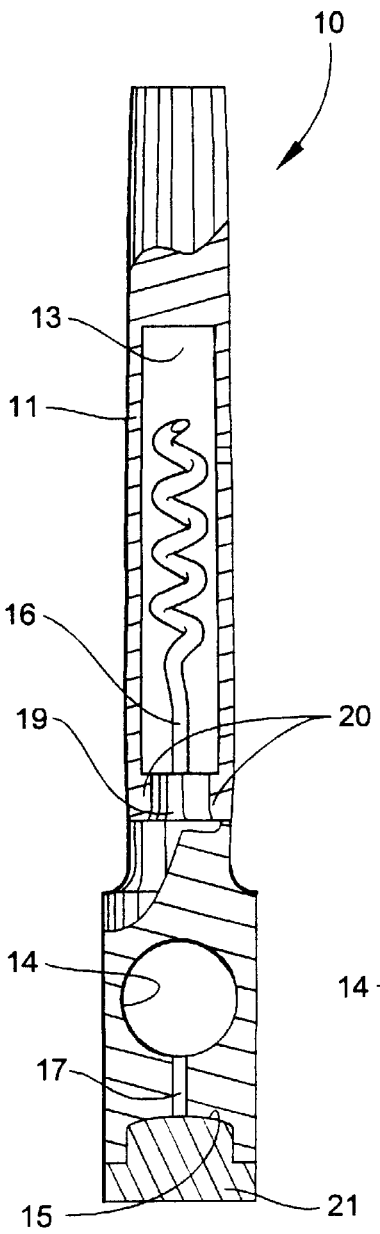
FIG. 1 is a partial cross-sectional view of the invention in the storage configuration taken along the longitudinal axis.
Figure 2:
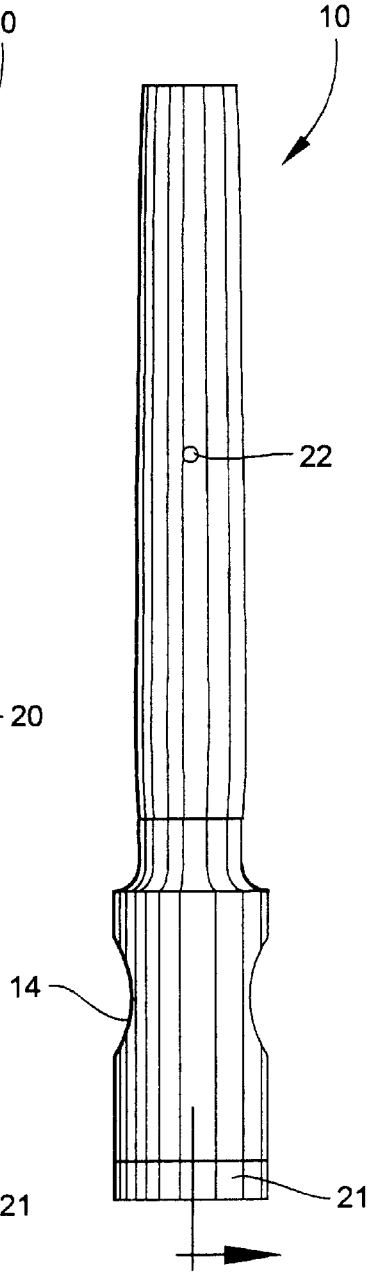
FIG. 2 is an exterior view of the invention in the storage configuration.
Figure 3:
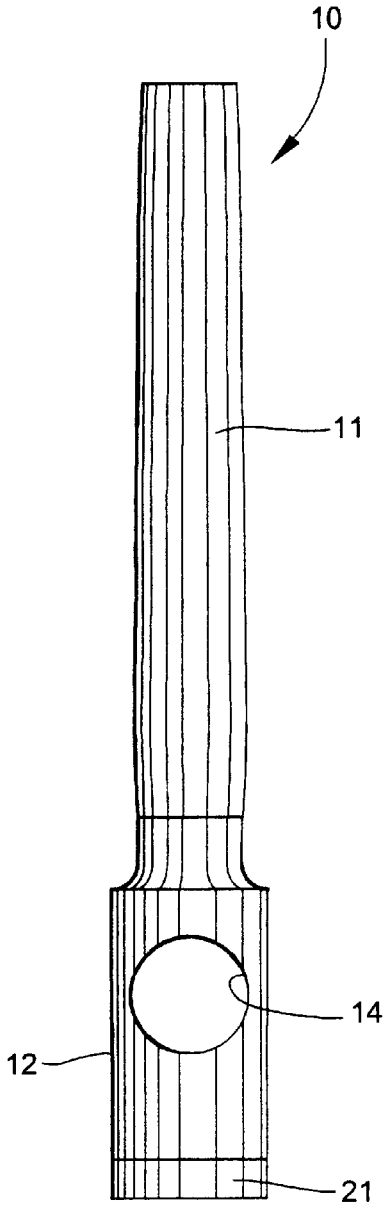
FIG. 3 is an exterior view of the invention in the storage configuration rotated ninety degrees from its view in FIG. 2.

Referring now specifically to the drawings, a combination corkscrew tool and pipe according to the present invention is illustrated in the storage configuration in FIGS. 1, 2, and 3 and shown generally at reference numeral 10. The corkscrew tool and pipe combination 10 is comprised of two main components, a first handle member 11 and a second handle member 12.

The first handle member 11 has a bore 13 extending to and communicating with one end. The bore 13 in the first handle member 11 is of a large enough diameter to receive the corkscrew blade 16 of the second handle member 12 in the storage configuration.

The second handle member 12 has a transversely extending hole 14. A bowl 15 for holding smoking material is formed in one end of the second handle member 12 and a corkscrew blade 16 is inserted into the other end. The bowl 15 is connected to the hole 14 in the second handle member 12 by a channel 17 to create a flow path between the two handle members 11 and 12.

Preferably, the first handle member 11 and the second handle member 12 define an interference fit when in the storage configuration. The second handle member 12 preferably includes a tapered shoulder 19 for being received within the bore 13 of the first handle member 11 such that the tapered shoulder 19 and a reduced-diameter shoulder 20 formed in the walls of the bore 13 define an interference fit permitting the blade 16 end to be secured within the bore 13 of the first handle member 11. An optional cap 21 is fitted to the bowl 15 end of the second handle member 12.

As is best shown in FIG. 2, an access port 22 communicates with the bore in the first handle member 11 for creating a flow path for smoke when the invention is used as a smoking pipe.

FIG. 3 shows a rotated view of the combination pipe and corkscrew tool 10 in the storage configuration, particularly displaying the hole 14 extending transversely through the second handle member 12.

Figure 4:
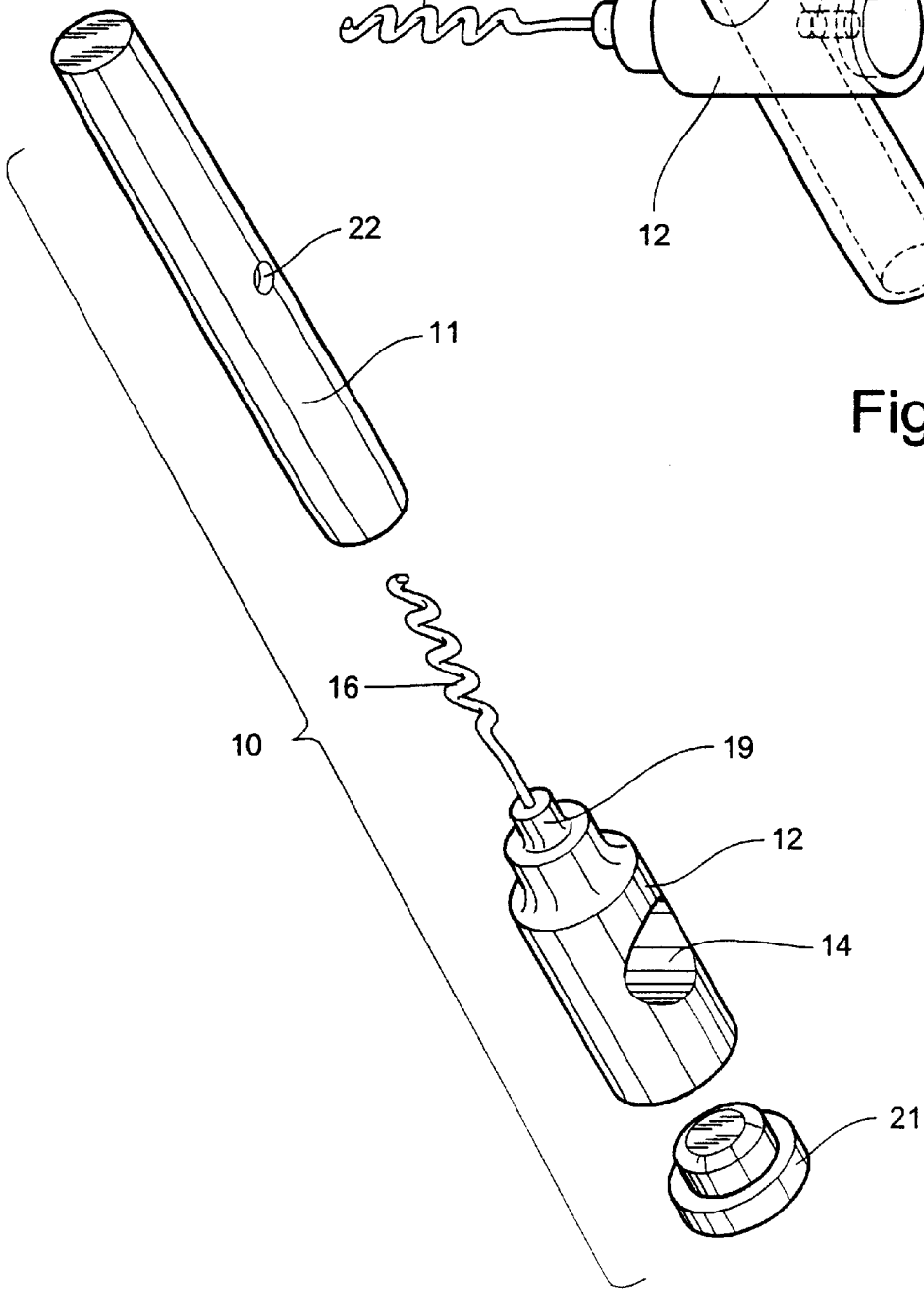
FIG. 4 is a perspective view of the invention in a disassembled position.

A disassembled view of the combination pipe and corkscrew tool 10 showing the first handle member 11, the second handle member 12 and an optional cap 21 fitted to the bowl 15 end of the second handle member 12 is shown in FIG. 4.

Figure 5:
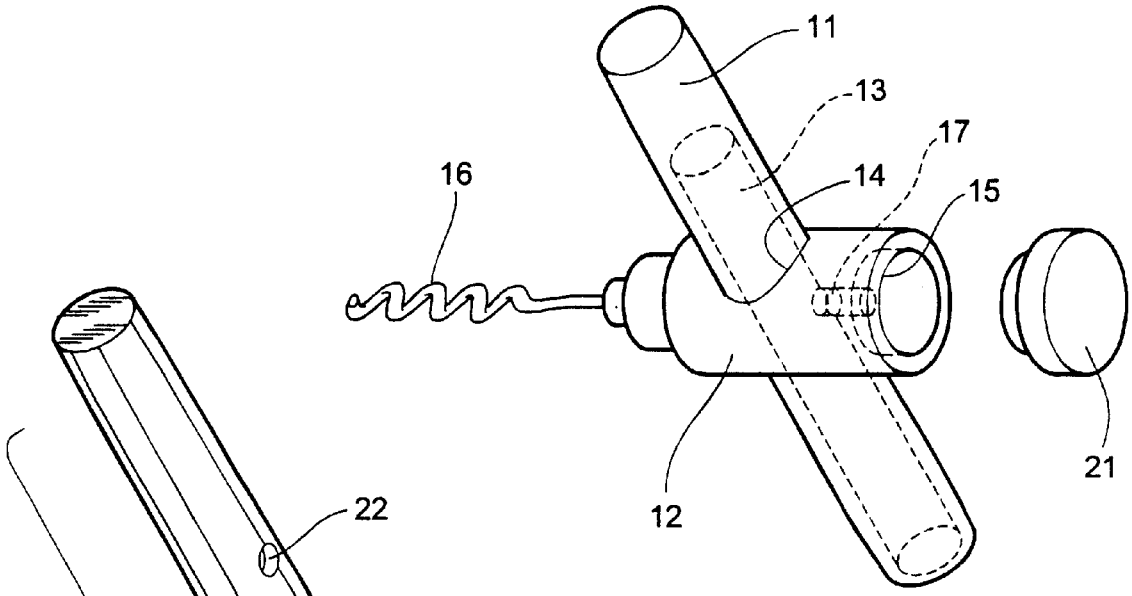
FIG. 5 is a perspective view of the invention in the use configuration.
Figure 7:
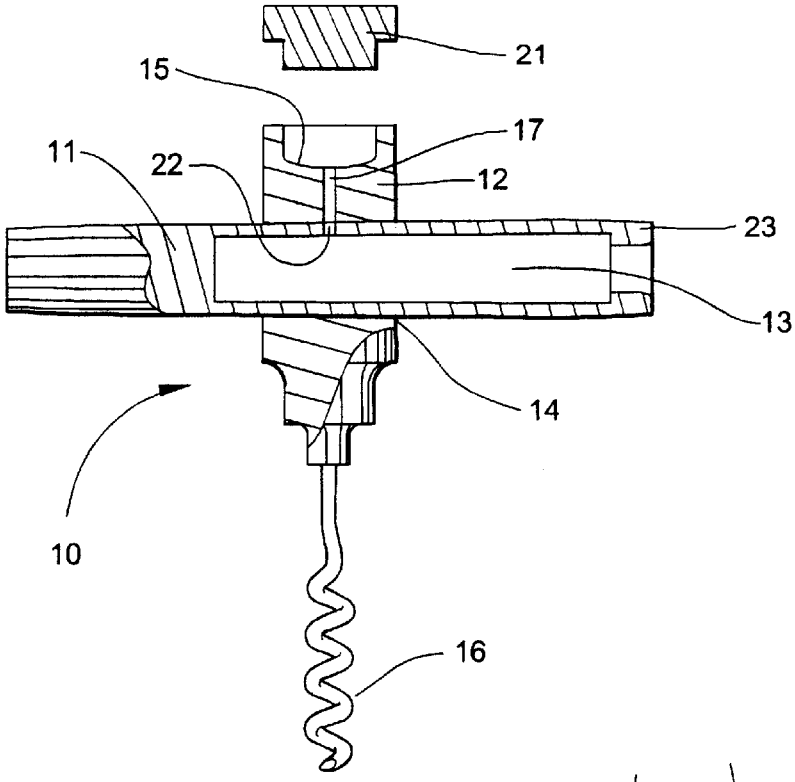
FIG. 7 is a partial cross-sectional view of the invention in the use configuration.
Figure 6:
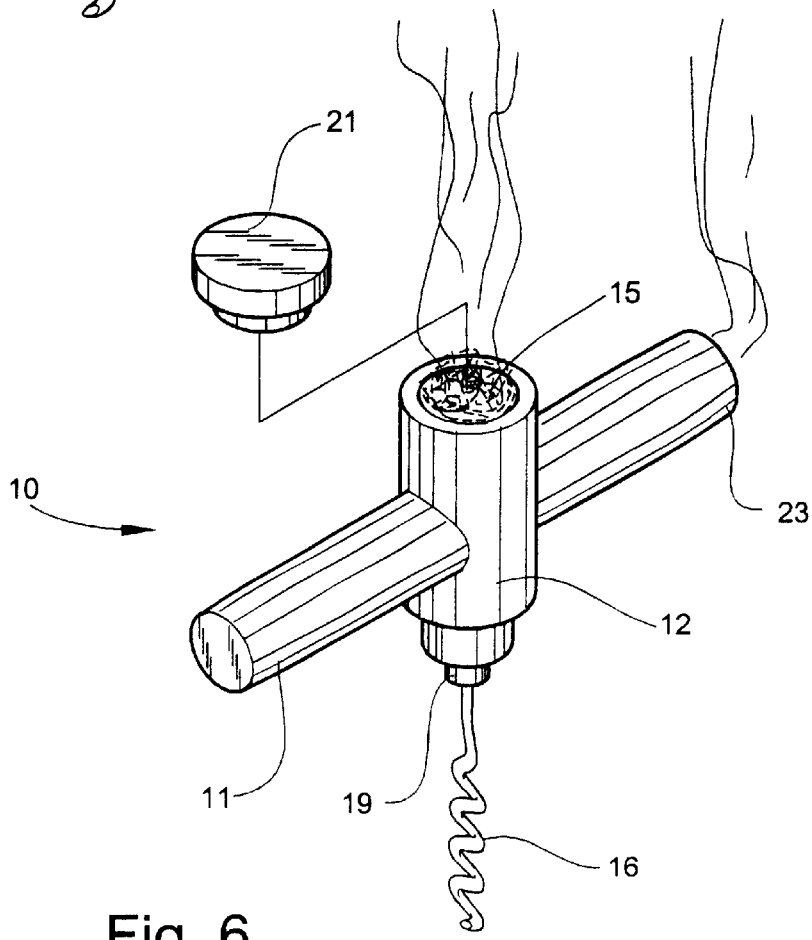
FIG. 6 is a perspective view of the invention being utilized as a smoking pipe.

FIGS. 5, 6, and 7 show the combination pipe and corkscrew tool 10 assembled in the use configuration. Such assembly permits the combination pipe and corkscrew tool 10 to be employed as either a smoking pipe, a corkscrew, or both. When the first handle member 11 is inserted into the hole 14 in the second handle member 12, the first handle member 11 allows the invention to be used as a corkscrew. In this same use configuration, a smoking pipe is created when the channel 17 connecting the bowl 15 of the second handle member 12 with the hole 14 in the second handle member is aligned and in communication with the bore 13 in the first handle member 11.

The invention is depicted in use as a pipe in FIG. 6. The optional cap 21 is removed and smoking material is placed in the bowl 15 of the second handle member 12. The bore 13 end of the first handle member 11 becomes a mouthpiece 23 when the invention is employed as a pipe. FIG. 7 depicts the flow path for smoke created through the alignment of the access port 22 of the first handle member 11 with the channel 17 of the second handle member 12 when the invention is assembled in the use configuration.

The invention may be designed such that the first handle member 11 has a tapered outer diameter where one end of the first handle member 11 is of a smaller diameter than the hole 14 in the second handle member 12 and one end of the first handle member 11 is of a larger diameter than the hole 14 in the second handle member 12. In this variation, the diameter of the first handle member 11 and the hole 14 in the second handle member 12 are the same where the channel 17 of the second handle member 12 and the access port 22 of the first handle member 11 are aligned to create a flow path and an interference fit releasably securing together the two handle members 11 and 12.

Both the hole 14 in the second handle member 12 and the entire first handle member 11 are depicted in the drawings as having a circular cross-section, which is optional.

Preferably, the first handle member 11 and the bowl 15 end of the second handle member 12 are made of wood, although other materials may be employed.

A corkscrew tool and pipe combination is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

What is claimed is:

1. A combination corkscrew tool and pipe comprising:

(a) a first handle member having a bore extending along the longitudinal axis and communicating with a one end of said first handle member to form a mouthpiece;

(b) an access port located on an outer surface of said first handle member and communicating with the bore;

(c) a second handle member having:

(i) a bowl in one end for holding smoking material;

(ii) a helical, cork-penetrating blade extending outwardly from an opposing end;

(iii) a hole extending transversely through said second handle member, intermediate the blade and the bowl, of a size and shape to receive said first handle member therethrough;

(iv) a channel through said second handle member connecting the bowl with the hole; and (d) wherein said first handle member and said second handle member are configurable in:

(i) a storage configuration wherein the helical, cork-penetrating blade is received in the bore of said first handle member; and (ii) a use configuration wherein said first handle member is positioned transversely through the hole in said second handle member with the access port of said first handle member in communication with the channel of said second handle member to form a flow path between the mouthpiece in said first handle member and the bowl in said second handle member permitting the combination to be used as a smoking pipe and a corkscrew tool in the same use configuration.

2. The combination corkscrew and pipe tool according to claim 1, wherein said first handle member and the bowl of said second handle member are comprised of wood.

3. The combination corkscrew and pipe tool according to claim 1, wherein said first handle member defines a gradually tapering outer diameter with one end having a greater diameter than the hole extending transversely through said second handle member and with the other end of lesser diameter than the hole, such that the diameter of said first handle member and the diameter of the hole in said second handle member are equal at a point where the access port in the first handle member and the channel through the bowl of said second handle member are aligned to define a flow path.

4. The combination corkscrew and pipe tool according to claim 1, wherein the bowl is fitted with a cap.

5. The combination corkscrew and pipe tool according to claim 1, wherein said first handle member defines a circular cross-section.

6. The combination corkscrew and pipe according to claim 1, wherein the blade end of said second handle member includes a tapered shoulder of reduced dimension for being received within the bore of said first handle member such that the tapered shoulder and walls of the bore define an interference fit permitting the blade end to be secured within of the bore of said first handle member.

7. A method of utilizing a combination corkscrew tool and pipe, comprising the steps of:

(a) providing a first handle member having a bore extending along a longitudinal axis and communicating With one end thereof defining a mouthpiece;

(b) providing an access port located on an outer surface of said first handle member and communicating with the bore;

(c) providing a second handle member having:

(i) a bowl in one end for holding smoking material;

(ii) a helical, cork-penetrating blade extending outwardly from an opposing end;

(iii) a hole extending transversely through said second handle member, intermediate the blade and the bowl, of a size and shape to receive said first handle member therethrough;

(iv) a channel through said second handle member connecting the bowl with the hole;

(d) configuring said first handle member and said second handle member into a storage configuration wherein the helical, cork-penetrating blade is received in the bore of said first handle member for storage; and (e) configuring said first handle member and said second handle member in a use configuration wherein said first handle member is positioned transversely through the hole in said second handle member to place the access port of said first handle member in communication with the channel of said second handle member, to form a flow path from the mouthpiece in said first handle member to the bowl in said second handle member permitting the combination to be used as a smoking pipe and a corkscrew tool in the same use configuration.

8. The combination corkscrew and pipe tool according to claim 7, including the step of producing said first handle member and the bowl of said second handle member of wood.

9. The combination corkscrew and pipe tool according to claim 7, including the step of providing said first handle member with a gradually tapering outer diameter having one end of greater diameter than the hole extending transversely through said second handle member and one end of lesser diameter than the hole such that the diameter of said first handle member and the diameter of the hole in said second handle member are equal at a point where the access port in said first handle member and the channel through the bowl of said second handle member are aligned to define a flow path.

10. The combination corkscrew and pipe tool according to claim 7, including the step of providing a cap fitted to the bowl of said second handle member.

11. The combination corkscrew and pipe tool according to claim 7, including the step of providing said first handle member with a circular cross-section.

12. The combination corkscrew and pipe according to claim 7, including the step of providing the blade end of said second handle member with a tapered shoulder of reduced dimension for being received within the bore of said first handle member such that the tapered shoulder and walls of the bore define an interference fit permitting the blade end to be secured within the walls of the bore of said first handle member.

* * * * *